US008810501B2

(12) United States Patent
Budzelaar et al.

(10) Patent No.: US 8,810,501 B2
(45) Date of Patent: Aug. 19, 2014

(54) METHOD AND SYSTEM FOR DRIVING A BACKLIGHT IN A DISPLAY

(75) Inventors: Franciscus Paulus Maria Budzelaar, Eindhoven (NL); Ardjan Dommisse, Kessel-lo (BE)

(73) Assignee: Koninklijke Philips N.V., Eindhoven (NL)

( * ) Notice: Subject to any disclaimer, the term of this patent is extended or adjusted under 35 U.S.C. 154(b) by 785 days.

(21) Appl. No.: 12/667,065

(22) PCT Filed: Jul. 1, 2008

(86) PCT No.: PCT/IB2008/052637

§ 371 (c)(1),
(2), (4) Date: Jun. 1, 2010

(87) PCT Pub. No.: WO2009/004574

PCT Pub. Date: Jan. 8, 2009

(65) Prior Publication Data

US 2010/0289833 A1 Nov. 18, 2010

(30) Foreign Application Priority Data

Jul. 4, 2007 (EP) ..... 07111756

(51) Int. Cl.
*G09G 3/36* (2006.01)

(52) U.S. Cl.
USPC ..... 345/102; 345/690

(58) Field of Classification Search
USPC ..... 345/690, 87–104, 204
See application file for complete search history.

(56) References Cited

U.S. PATENT DOCUMENTS 6,816,142 B2 * 11/2004 Oda et al. ..... 345/89
2003/0090455 A1 * 5/2003 Daly ..... 345/102
2005/0088400 A1 * 4/2005 Daly ..... 345/102
2005/0253825 A1 * 11/2005 Kawamura et al. ..... 345/204
2006/0125775 A1 * 6/2006 Itoh ..... 345/102
2006/0214904 A1 * 9/2006 Kimura et al. ..... 345/102
2006/0238487 A1 10/2006 Shih

FOREIGN PATENT DOCUMENTS

EP 1705636 A1 9/2006
JP 2005309338 A 11/2005
JP 2007034251 A 2/2007
WO WO 2006006315 A1 * 1/2006
WO 2006045424 A1 5/2006

OTHER PUBLICATIONS

Shiga et al: "49.2: Reduction of LCTV Backlight Power and Enhancement of Gray Scale Capability by Using an Adaptive Dimming Technique"; SID Symposium Digest of Technical Papers, May 2003, vol. 34, Issue 1, pp. 1364-1367.
Shirai et al: "44.4: RGB-LED Backlights for LCD-TV's With 0D,1D, and 2D Adaptive Dimming"; SID Symposium Digest of Technical Papers, Society for Information Display, Jun. 2006, vol. 37, Issue1, pp. 1520-1523.

* cited by examiner

*Primary Examiner* — Stephen Sherman

(57) ABSTRACT

A backlight control system is configured to control a backlight of a display that includes light sources positioned at light source positions for providing illumination to the backside of the display panel. The system includes a drive value generator configured to provide light source drive values for causing the backlight profile to gradually descend around a high luminance portion of the display at a rate that is independent of a position of the high luminance portion with respect to the light source positions. The high luminance portion of the display has a higher luminance than an area around the high luminance portion of the display.

17 Claims, 7 Drawing Sheets

METHOD AND SYSTEM FOR DRIVING A BACKLIGHT IN A DISPLAY

FIELD OF THE INVENTION

The invention relates to a backlight of a display.

BACKGROUND OF THE INVENTION

Conventional LCD televisions and LCD computer monitors comprise a transmissive LCD panel and a backlight that generates a more or less uniform and constant luminance pattern onto the backside of the LCD panel. The LCD panel modulates this light into the desired colors and luminances to create a rendering of an image.

In "44.4*: RGB-LED Backlights for LCD-TVs with* 0*D,* 1*D, and* 2*D Adaptive Dimming"*, by T. Shirai, in: *SID Symposium Digest of Technical Papers, Society for Information Display*, June 2006, Volume 37, Issue 1, pp. 1520-1523, RGB-LED backlights for LCD-TVs with 0D, 1D, and 2D adaptive dimming are discussed. Output luminance of an RGB-LED backlight for an LCD-TV was adaptively dimmed along with input video signal in fashions of 0D (uniform dimming), 1D (line dimming), and 2D (local dimming). The dimming factor is chosen so that the perceived image after the adaptive dimming becomes identical to that of the original image, that the maximum video signal among all the LCD pixels corresponding to the block after the dimming operation becomes equal to the maximum limit for driving the LC module, and also that the total power consumption of the backlight unit becomes minimum. The gamma characteristics of the LCD module as well as leakage light through the LCD module are also taken into account in the calculation of said maximum video signal.

This adaptive dimming system allows for improvement.

SUMMARY OF THE INVENTION

It would be advantageous to have an improved way of controlling a backlight of a display. To better address this concern, in a first aspect of the invention a system is presented for controlling a backlight of a display, wherein the display comprises:

a transmissive display panel; and a backlight for providing an illumination to a backside of the display panel, the backlight comprising a plurality of respective light sources positioned at respective predetermined light source positions for providing illumination to respective overlapping portions of the backside of the display panel according to respective predetermined light source luminance profiles, wherein an intensity of the light source luminance profile is scalable by means of a light source drive value, and wherein a superposition of the respective scaled light source luminance profiles defines a backlight profile.

The system comprises:

a drive value generator for providing the light source drive values in dependence on image luminance values corresponding to an image to be displayed by the display, the drive value generator being arranged for causing the backlight profile to gradually descend around a high luminance portion of the display at a rate that is independent of a position of the high luminance portion with respect to the light source positions, the high luminance portion of the display having a higher luminance than an area around the high luminance portion of the display.

The backlight intensity is controlled by locally setting the backlight intensity in dependence on image luminance. It allows to reduce the power dissipation of the backlight, because it is no longer necessary to keep the backlight at full intensity at all times. Also, compared to displays with a backlight that can be attenuated, the power dissipation can be further reduced by locally reducing the backlight where image luminance is low. Also, this embodiment allows to enhance the contrast, because a low luminance backlight is provided to dark image portions. This allows creation of darker regions by setting the intensity low where the image has low luminance, and allows creation of brighter regions by setting the intensity high where the image has high luminance.

Because the transmissive display panel is not completely opaque in dark areas due to technological limitations, some of the light provided to these dark areas will be visible to the viewer. This effect is known as halo. By causing the backlight profile to gradually descend around the high luminance portion, independent of the light source positions, the halo effect becomes less disturbing to the viewer. The resulting image is more attractive to the viewer. The viewing overall image quality is improved.

In an embodiment, the drive value generator comprises:

means for establishing respective candidate drive values for respective light sources based on a luminance in a predetermined portion of the image to be displayed on a predetermined portion of the display, wherein the candidate drive values correspond to light source drive values that would, when applied to the backlight, cause the backlight to generate a predetermined backlight profile that has a maximum luminance at the predetermined portion of the display and that gradually descends around the predetermined portion of the display at a predetermined rate that is independent of a position of the predetermined portion of the display with respect to the light source positions, wherein the means for establishing the candidate drive values is arranged for establishing candidate drive values with respect to a plurality of predetermined portions of the image to obtain a plurality of candidate drive values for at least one of the light sources; and means for establishing the light source drive value of the at least one of the light sources in dependence on the candidate drive values.

This is an efficient way to realize the desired backlight profile. By establishing candidate drive values based on predetermined portions of the image, the computations are organized in an efficient manner. The drive value generator may be arranged for using a maximum of the candidate drive values that have been established for a light source. Similarly, a minimum may be used or an average or mean value. Also, any function of the candidate drive values may be used, such as a statistical function.

In an embodiment, the means for establishing the light source drive value comprises means for establishing a maximum drive value among the candidate drive values for the at least one of the light sources. This ensures that the luminance of the backlight is not too low.

In an embodiment, the predetermined backlight profile has a shape representing an enlarged shape of the light source luminance profile.

In an embodiment, the predetermined backlight profile has a limited radius of less than five times a distance between two light sources. This way, only a limited number of light sources need to contribute to a predetermined backlight profile. This reduces the computational effort required to compute the drive values. Also, contrast is enhanced because light is provided locally where it is needed and only a limited region around it. The remaining display area remains unlighted, which results in an improved rendering of dark objects. Preferably, the predetermined backlight profile has a limited radius of at most 2 times a distance between two light sources. Preferably, the predetermined backlight profile has a limited radius of at most 1.5 times a distance between two light sources.

In an embodiment, the means for establishing the candidate drive values comprises:

means for establishing a weight value in dependence on a location of the predetermined portion of the display relative to a location of at least one of the light sources; and means for computing a product of the weight value and a value representing the luminance of the predetermined portion of the image.

The weight values are a practical and efficient way to compute the required drive value for a light source to create a virtual profile. They allow to pre-compute the weight values in a look-up table.

In an embodiment, the means for establishing a weight value and the means for computing the product are arranged for being applied to respective ones of a plurality of predetermined portions of the display, a number of predetermined portions being larger than a number of light sources. The number of predetermined portions metaphorically corresponds to a number of virtual light sources each producing a virtual light source profile. Because of the large number of predetermined portions, a large number of virtual light sources is simulated. Accordingly it seems to the viewer that the number of light sources is larger than the actual number of light sources.

In an embodiment, the drive value generator comprises means for selecting a predetermined backlight profile among a plurality of predetermined backlight profiles having different shapes in dependence on the luminance in the predetermined portion of the image. This allows for more options for fine-tuning the backlight control system.

In an embodiment, a predetermined backlight profile with a flat top is selected if at least one of the image luminance values exceeds a predetermined threshold value, to increase the maximum of the predetermined backlight profile. A profile with a flat top allows more light sources to be used at their maximum intensity. This way, the total luminance at a given spot of the display can be enlarged. This is especially suitable for small, high luminance spots.

An embodiment comprises a display comprising:

a transmissive display panel;

a backlight as set forth; and;

a backlight control system comprising a drive value generator as set forth.

The display panel may comprise an LCD panel. The light sources may comprise LED's.

The display may be part of a television or computer monitor.

An embodiment comprises a method of controlling a backlight of a display, the method comprising:

providing the light source drive values in dependence on image luminance values corresponding to an image to be displayed by the display, the drive value generator being arranged for causing the backlight profile to gradually decline around a portion of the display at a rate that is independent of the light source positions, the portion of the display comprising a higher luminance than an area around the portion of the display according to the image luminance values.

An embodiment comprises a computer program product for controlling a backlight of a display, the computer program product comprising instructions for:

providing the light source drive values in dependence on image luminance values corresponding to an image to be displayed by the display, the drive value generator being arranged for causing the backlight profile to gradually decline around a portion of the display at a rate that is independent of the light source positions, the portion of the display comprising a higher luminance than an area around the portion of the display according to the image luminance values.

BRIEF DESCRIPTION OF THE DRAWINGS

These and other aspects of the invention will be further elucidated and described with reference to the drawing, in which FIG. 1 provides an impression of an example of the light generated by a dimmable backlight.

DETAILED DESCRIPTION OF EMBODIMENTS

Figure 1:
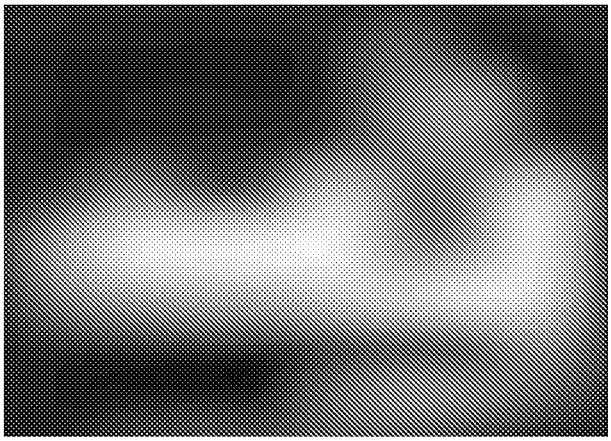

Conventional LCD display systems comprise a backlight that generates a uniform luminance pattern onto the backside of the LCD, after which the LCD panel modulates this light to the desired image. Backlight dimming is based on the idea that the backlight itself can be modulated too, generating only light where and when it is needed.

The optimal design of a 2D dimming backlight system involves a large number of trade-offs, and depends on a wide set of design targets. Four important reasons to use 2D dimming are power saving, local peaking, contrast and viewing angle improvement.

2D dimming may however introduce artifacts, for example: halos around bright objects, visible backlight structure and color and/or luminance non-uniformity.

When designing a system for controlling the 2D dimming feature, there is a trade-off between power saving and reduction of artifacts. The choice depends on, for example, the type of LCD panel used: if panels are used that can render dark regions very well regardless of the intensity of the backlight, then power reduction will be relatively important. Otherwise, reduction of backlight structure artifacts is usually more important.

Preferably, a relatively large number of LEDs are used in the backlight. Contrast may be improved when a high number of LEDs is used in the backlight; the halos caused by light 'leaking' to dark areas are then narrow enough to be hidden due to limitations of the human visual system.

When only a small number of LEDs is used, the goals of power saving and/or local peaking may still be achieved.

Several variants of backlight dimming systems may be realized. In the first variant, called 0D dimming, the backlight still generates a uniform luminance pattern, but the its intensity is modulated, based on the requirements derived from the video contents. The signal to the LCD panel has to be modified as well to compensate for the modulated backlight output. Some advantages of 0D dimming are:

- Reduced power consumption: the backlight requires less power for rendering darker scenes.
- An improved contrast, especially for dark scenes: LCD light leakage will be less if the backlight level is lower.
- A viewing angle improvement, especially for dark scenes. LCD behaves less well for low transmission values. With dimming, the LCD transmission values will be higher to compensate for the reduced backlight. This way, the properties of high-transmission LCD now also apply to darker scenes.

The above advantages also apply to 1D dimming and 2D dimming, which will be defined below.

1D dimming means that the backlight is divided in horizontal or vertical strips that can be modulated separately. 1D dimming improves on all three aspects with respect to 0D dimming. Furthermore, when a panel has an overall power consumption limit, it becomes possible to render higher peak brightness if the overall brightness is sufficiently low.

Although vertical strips are possible, preferably horizontal strips are used. Fluorescent lamps tend to work optimally when operated in a horizontal position. Furthermore, most natural scenes tend to have a rather horizontally oriented division (for example as in a scene of a landscape with sky), for which vertical segmenting works better.

With 2D dimming, the backlight is divided in small segments that can be controlled separately. FIG. 1 shows an impression of the light generated by such a 2D dimmable backlight. Again, this improves on all four aspects with respect to 1D dimming.

0D and 1D dimming is possible with e.g. a conventional cold cathode fluorescent light (CCFL), although such a light has only limited modulation depth. 2D dimming requires small light sources, for example light emitting diodes (LEDs).

Figure 2:
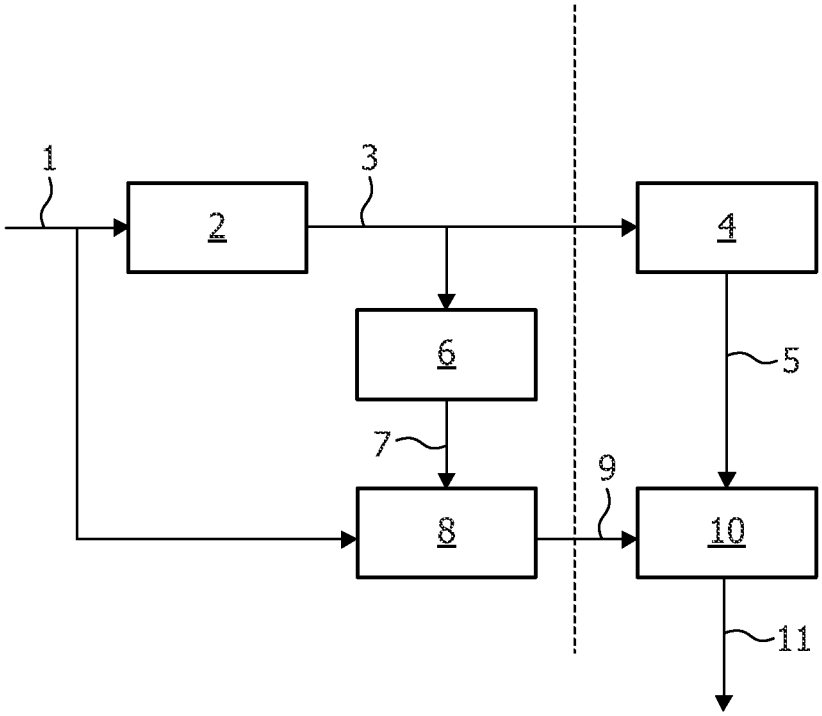
FIG. 2 is a diagram of an embodiment.

FIG. 2 shows an example architecture of a dimming LCD system. This generic architecture is valid for 0D, 1D and 2D systems. An input signal 1 describes an image that is to be rendered. For example, it describes the target intensities of Red, Green, and Blue channels for each pixel in the image, using a data format known in the art. A LED drive value generator 2 derives a series of LED drive values 3 that are used to drive the LED backlight 4 in dependence on the input signal 1. This will generate a light pattern 5 on the LCD panel 10 with a spatial distribution of the luminance according to the LED drive values. This light is to be modulated by the LCD to realize the target image 11 corresponding to input signal 1. To derive the proper LCD drive values 9, a second processing path is provided. Light simulation unit 6 provides a simulation of the physical LED backlight 4 to obtain the light intensities provided to the LCD panel. Thus, from the LED drive values 3, the actual generated distribution of light 7 is calculated in the light simulation unit 6. This actual generated distribution of light is provided to an LCD drive value generator 8. This LCD drive value generator 8 provides drive values for the LCD panel using the light distribution 7 and the input signal that describes the image that is to be generated. For example, the LCD drive value generator 8 performs a division of the actual backlight at a pixel and the color intensity of the image to be generated at that pixel.

To allow proper creation of the desired image the algorithm used in LED drive value generator 2 preferably is arranged for generating drive values 3 that cause the light 5 generated by the backlight 4 to be enough to allow the LCD panel 10 to attenuate the light 5 to the proper value 11.

To achieve maximum power reduction, the LED drive value generator 2 may select drive values such that it minimizes the sum of the drive values 3, while still fulfilling the requirement that the light 5 generated by the backlight 4 is enough to allow the LCD panel 10 to attenuate the light 5 to the proper value 11.

The LED drive value generator 2 does not need to be perfect, as long as the minimally required backlight intensity is provided. A somewhat less optimal but easier to implement algorithm can still yield good images. However, preferably the simulation unit 6 is very accurate. Any differences between the simulated luminance distribution and the actual generated luminance distribution may become visible as luminance errors in the final picture.

The efficiency of dimming, especially 0D dimming, is may be limited in the presence of a few bright spots in the image. In such cases, a compromise can be to reduce the brightness of these areas using soft-clipping to boost power efficiency, and improve performance in dark regions.

One of the reasons to dim a backlight is to increase contrast: even when using a panel with a poor contrast, light cannot leak through it when it is not generated in the first place, yielding an extreme high system contrast. However, a LED backlight cannot generate an arbitrary light distribution on the LCD panel. It is limited by the organization of the LEDs, usually a matrix, and by the spreading of the light of the LEDs onto the LCD panel.

Figure 3:
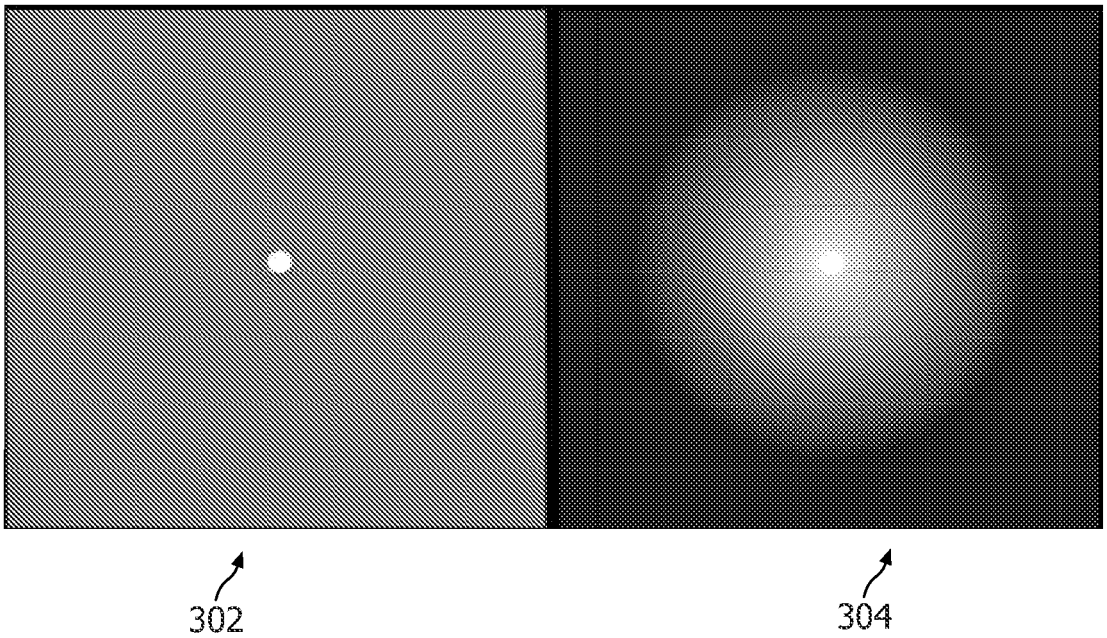
FIG. 3 illustrates a rendering of a bright spot.

When generating the light needed for a bright area, some of the generated light may be provided to a neighboring dark area. This light will partially leak through the LCD, and therefore a faint "halo" of light may be generated around bright objects. FIG. 3 shows an (exaggerated) example of this. The FIG. 3 illustrates a rendering 302 using a low contrast panel with a non-dimmed backlight rendering a white dot on a black background. At rendering 304, the same white dot on a black background is shown using the same panel but with a 2D dimmed backlight. It can be appreciated that a halo is present around the white spot when using the dimmed backlight. It can also be appreciated that the contrast is better using the dimmed backlight: a darker region is produced compared to the rendering 302 produced with the non-dimmed backlight.

The presence of halos does not need to be a problem. The human eye has a limited local contrast range, so details in a dark region neighboring a bright region are invisible. Therefore, as long as this halo as a limited width, it will be (almost) invisible, or at least acceptable, to the human observer.

Figure 4:
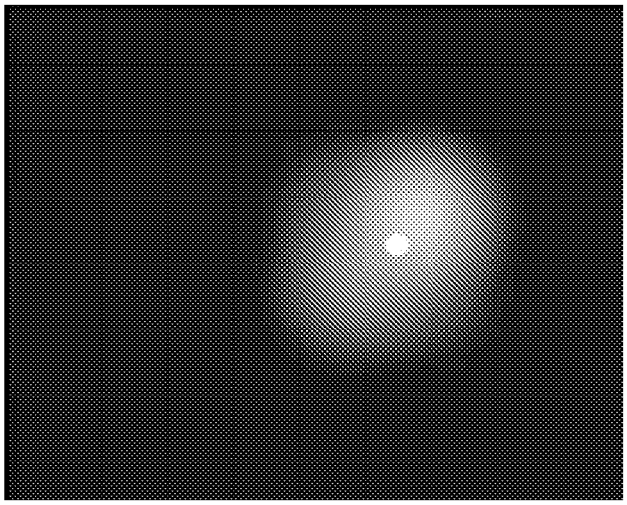
FIG. 4 illustrates a rendering of a bright spot.

However, the halo may faintly show the structure of the backlight, for example the arrangement of the light sources of the backlight. FIG. 4 shows an example of this. It can be seen in FIG. 4 that the backlight intensity is largest somewhere to right and above the bright spot. This may be hardly visible for static images, but when a moving scene is shown, the halo shape around bright areas will change with the position. This is perceived as annoying.

Perception tests have revealed that the visibility of halos is related to both the contrast difference and the (relative) width of the halos. Halos that are narrow are hardly visibly, even if the local black level in it is very poor. This is due to limitations of the human vision system. Bright areas mask nearby dark areas. When an observer looks at a point source (e.g. bright LED), the visual system introduces a (non-existing) halo around it. However, the brain is trained to ignore it. The observer only sees it when he consciously tries to.

This leads to the following conclusions. If the width of the introduced halos remains within the masked area, the shape and brightness of the halos is not very relevant because it is not noticed by the observer. However, if the width is wider, the contrast reduction due to the halo is preferably limited; otherwise it will be visible. Also, the shape of the halo should not depend on the position on the panel. It should be noticed that artifacts that are invisible at normal television looking distance may become visible when looking at the display from nearby.

There is a direct relation between the width of the halos and the number of LEDs in the backlight. If the contrast of the panel is so poor that halos will be visible, then preferably a sufficient number of LEDs with the right profile is used so that the introduced halos are sufficiently narrow to remain unnoticed.

With the introduction of LEDs, it is possible to drive the three (or more) primary colors generated by the backlight separately. This may be used to dim these colors separately, to further reduce power consumption and enhance contrast.

One of the factors influencing the result of a 2D dimming system is the shape of the luminance profile that a LED projects onto the LCD panel. Although the light generated by the LEDs have a specific angular component, depending on the location on the LCD screen, a diffuser can be used to remove this component. Also, preferably optical components are provided to polarize the light produced by the LED before it reaches the LCD panel.

The term LED profile is used to indicate the profile of the intensity of the polarized light that is cast onto the LCD panel. In this document only circular profiles are described in detail. However, a skilled person will appreciate that it is possible to extend the methods and systems described herein to non-circular profiles.

The position on the LCD panel directly in front of the LED is assumed to be the centre of the profile. Distance r is the distance between a position on the LCD and this centre. The luminance L can now be described as L(r).

Figure 5:
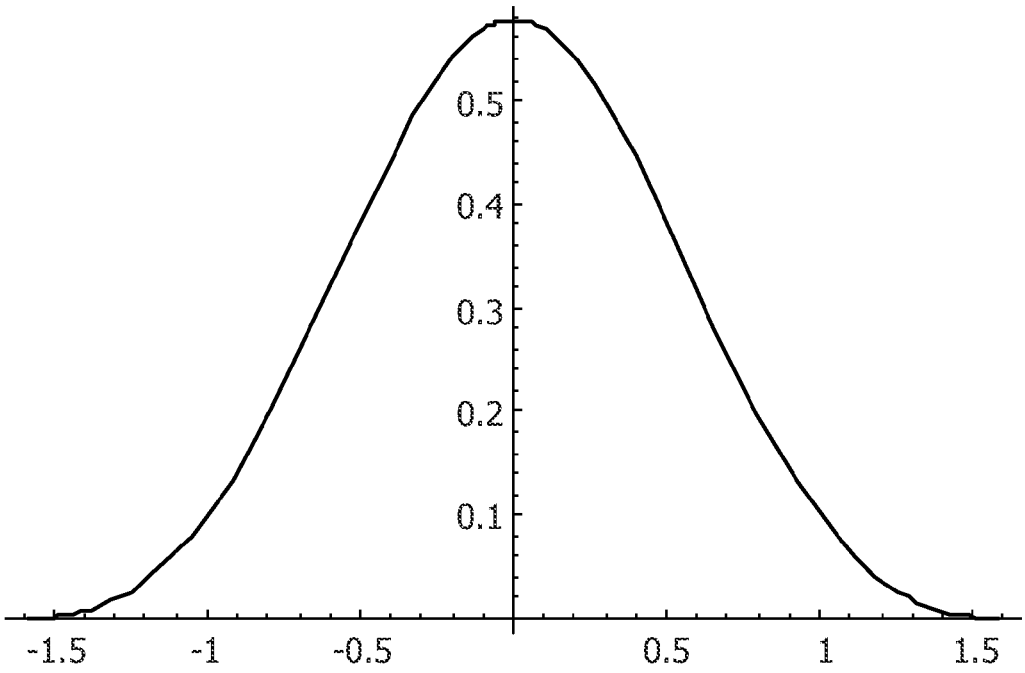
FIG. 5 illustrates a luminance profile of a light source.

Two classes of profiles may be distinguished. Unlimited profiles show L(r) to become small for large values of r, but will never be 0. The Gaussian and Lorenz profiles are examples of unlimited profiles. Limited profiles however, have a parameter R, the radius of the profile. For r>R, the luminance is 0 (or at least very small). FIG. 5 shows an example of a limited profile with R=1.5. It shows on the horizontal axis the distance r between a position on the LCD panel and the center of the profile. On the vertical axis it shows the brightness provided by the LED in an arbitrary unit. The limited profiles have interesting properties. Because of the limited range, only LEDs closer than R to a specific point on the LCD panel have to be taken into account when calculating the summed light, making the algorithms simpler. Also, black areas will be very dark when they are far enough from brighter area. If the light is spread out over a large area (large R), the shape of the halo will be very soft, and no backlight structure will be visible.

If the shape of the profile is limited (small R), only a few LEDs will contribute to a specific position, and the halo width will be narrow. Peak brightness can be achieved by switching on only a few LEDs. But it may show the structure of the backlight. Narrow profiles may result in higher power reduction. And as fewer LEDs contribute to a particular position, calculating the amount of light at that position needs to consider only a smaller set of LEDs, making the calculation easier.

Figure 6:
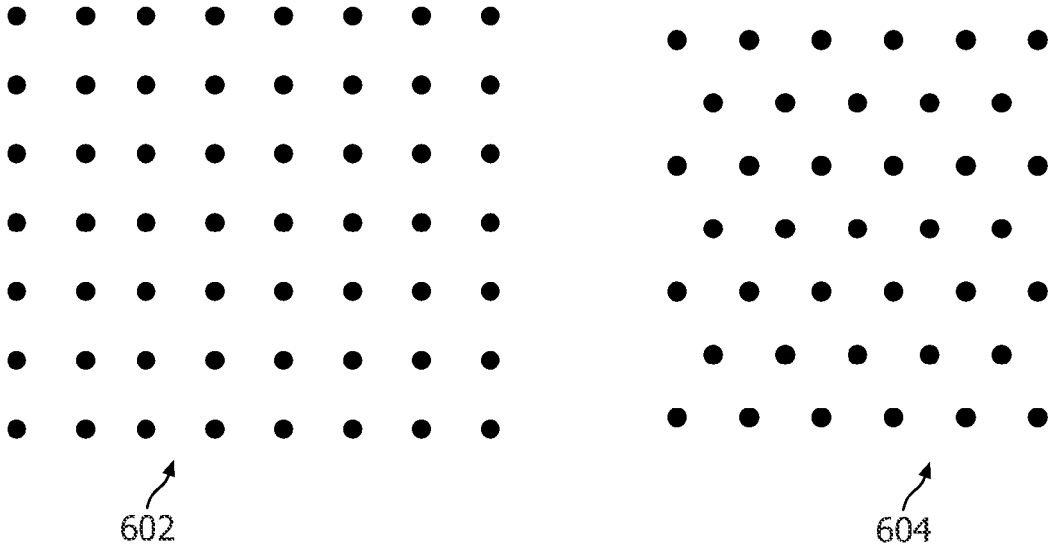
FIG. 6 illustrates two arrangements of light sources.

In principle, the LEDs can be arranged in any way that is convenient. For 1D and 2D dimmable systems, the flatness of the profile is closely related to the LED arrangement, especially for narrow profiles. Arrangements with symmetry have advantages in this area. Furthermore, a symmetrical arrangement reduces computational complexity in the algorithms. Therefore preferably symmetrical set-ups of the LEDs are used for 1D and 2D dimming systems, for example square 602 and equilateral triangular 604. Both are shown in FIG. 6. An advantage of the square 602 arrangement is that it allows placement of mirroring borders relatively easily because of its symmetry properties.

The simulation of the light that the backlight casts on the LCD (block 6 of FIG. 2) may be realized as follows. Assume N is the number of pixels of the LCD, and M the number of LEDs in the backlight. For each path from a LED to a pixel, there is an attenuation coefficient $A_{ij}$, which depends on the LED profile and the distance from the LED to the pixel. The light $L_j$ that is received by a pixel j is obtained by a summation of the light emitted by LEDs i, multiplied by the attenuation coefficients:

$$L_j = \sum_{i=1}^{M} A_{ij} L_i.$$

However, this formula requires a relatively large number of computations. It may be simplified by for instance use of symmetry, limited LED profile radius and allowing small errors is needed to reduce the number of calculations and the required memory to a manageable amount.

In implementing the LED drive value generator (block 2 in FIG. 2), there is a freedom in optimization of LED drive values for a specific goal. Preferably, the LED drive value generator 2 ensures that every pixel at least receives the amount of light that it should transfer according to the input signal 1. This may be done by solving a set of inequalities. If $V_j$ describes the minimum required amount of light for pixel j, then:

$$V_j \leq \sum_{i=1}^{M} A_{ij} L_i.$$

Preferably, the $A_{ij}$ are selected such that there is always at least one solution to this set of inequalities, i.e. the situation where all LEDs are driven at their maximum (i.e. no dimming is used). However, usually there are an infinite number of solutions. Finding and/or selecting the best one depends on the implementation.

When the intrinsic contrast of the LCD panel is not very high, light from the backlight will leak through the panel also in dark areas (as illustrated at numeral 302). This by itself may be annoying. However, a visible static structure of the backlight (as illustrated in FIG. 4) is much more disturbing. In panning scenes, this static structure will cause a "dirty window" effect that degrades the image quality. Therefore, one goal can be to minimize the visibility of the arrangement of the backlight LEDs. There are at least two elements that contribute to this visibility. The physical design of the backlight is one, including properties like LED pitch, light mixing, profile width, etc. But even a well-designed backlight may perform poorly if driven improperly. The algorithm that is used to derive the drive values from the video information therefore also contributes to bringing the best out of the system.

In principle, there is one solution, or a set of equally performing solutions, of LED drive values that offers minimal power consumption. To reduce computational complexity, it is possible to use an approximation of the minimal power consumption solution. Note that the minimal artifacts and minimal power approach may yield rather different results.

Ideally, the LED drive value generator takes into account the drive values for each pixel on the LCD screen separately. Current HDTV screens (1920 by 1080 pixels) feature around 2 million pixels, which means that vast amounts of data would have to be processed at a very high rate to achieve this. To reduce the computational complexity, the image can be down sampled to a more manageable size for the purpose of LED drive value generation, e.g. to 192×108 areas, reducing the number of calculations with a factor of 100, and introducing only marginal errors. Preferably, the maximum luminance level in an area of pixels is used in the downsampled version. This general principle can be applied to all described implementations of the LED drive value generator.

The LED drive value generator may also be simplified by assuming a simpler LED profile than the actual physical profile. When a profile is used that, for any position, predicts less light than the actual profile, results based on this algorithm will still fulfill the requirement that there should always be at least enough light at any pixel position. Preferably, the simulation unit 6 uses the actual physical profile to compute the actual intensity of the backlight for the pixel positions. This allows more accurate LCD drive values to be generated by the LCD drive value generator 8, which results in a better rendering 11. This simplification may make the system a bit less power efficient. However, the algorithm may become easier to implement and computationally less expensive.

In an embodiment of LED drive value generator 2, a fairly efficient and extremely simple algorithm is employed. To obtain a specific brightness, it is sufficient to switch on all LEDs within range (r<R) to be driven with the same drive value. If other areas require another brightness of a LED, the maximum of the drive values is taken. This drive algorithm however may show severe "jumpiness" in the drive values when bright objects move around on the screen, so are moving in and out of the area defined by radius R. Also halos are relatively large and may show the LED pixel structure.

In another embodiment of LED drive value generator 2, a somewhat more complex, but far more power efficient algorithm exploits the fact the LED nearest to the position requiring light is the most efficient one to use. Each position is processed sequentially. From the amount of light needed, a drive value is computed for the LED nearest to that position. If the required drive value is less than 100%, enough light can be generated by this LED, and the algorithm can continue with the next position. If it is higher than 100%, this value is clipped to 100%, and the next nearest LED is used to generate the missing light. This continues until sufficient light is generated. This drive algorithm however may also show severe "jumpiness" in the drive values when bright objects move around on the screen.

In another embodiment of LED drive value generator 2, an extension of the previously described algorithm is used. It works in multiple passes. In the first pass, a drive value of the LED nearest by is computed. This value is clipped to 100%. Of all drive values computed for a particular LED, the highest value is stored. In the second pass, the actual luminance level for each pixel is computed, based on the stored LED drive values. For most LEDs, the luminance level will now be equal to or higher than the needed level. However, some pixels may still not receive enough light. To overcome this, new (higher) drive values are calculated for the second nearest LED (the nearest LED is already on 100%). This process can be repeated until all pixels receive enough light.

Figure 7:
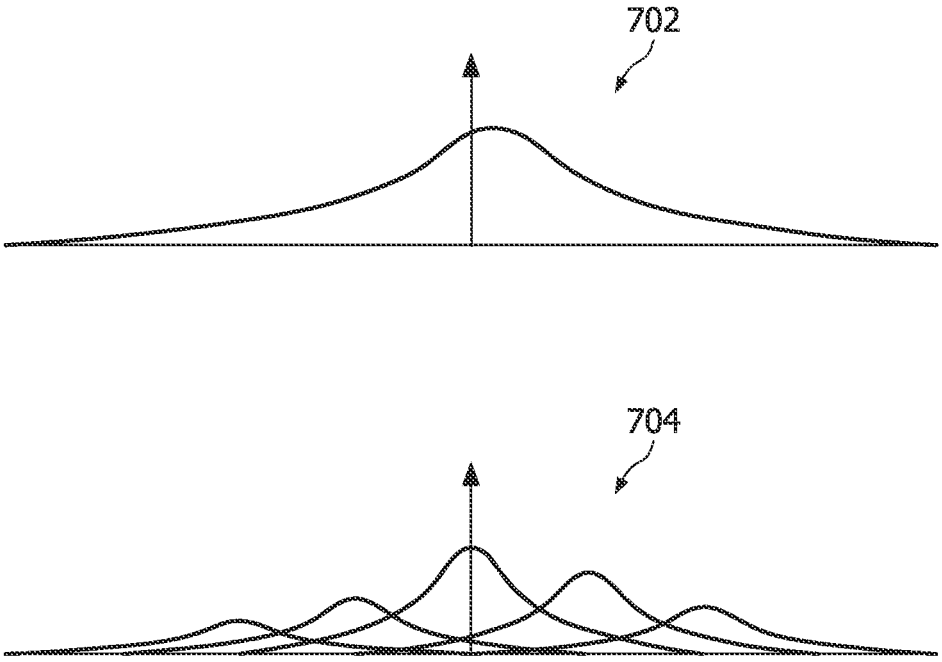
FIG. 7 illustrates a backlight profile profiles.

In another, preferred embodiment of the LED drive value generator 2, an algorithm is used provides a low visibility of the backlight structure. The algorithm is based on the idea that it is possible to emulate a virtual LED and associated virtual LED profile at any arbitrary position on the screen by driving physical LEDs with proper drive values. For example, each pixel can have its own virtual LED. A set of coefficients is associated with each virtual LED that describes the ratio of the contributions of the surrounding physical LEDs. FIG. 7 shows in graph 704 one-dimensional representations of the profiles of five LEDs at different positions driven with different drive values. In graph 702, the resulting virtual profile is shown. Graphs 702 and 704 show position on the horizontal axis and luminance on the vertical axis. It can be seen that the virtual profile 702 reaches a maximum in between the maxima of two neighboring individual physical profiles. By properly driving the LEDs, the maximum of the virtual profile can be positioned at any position at will.

Figure 8A:
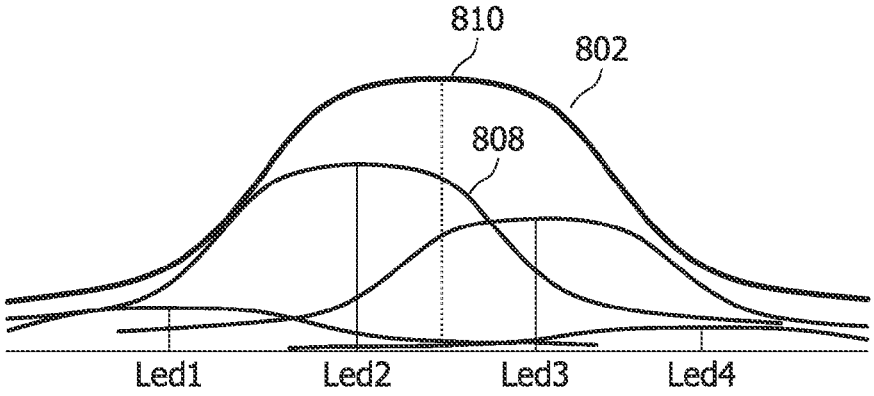
FIG. 8 illustrates several backlight profiles.
Figure 8B:
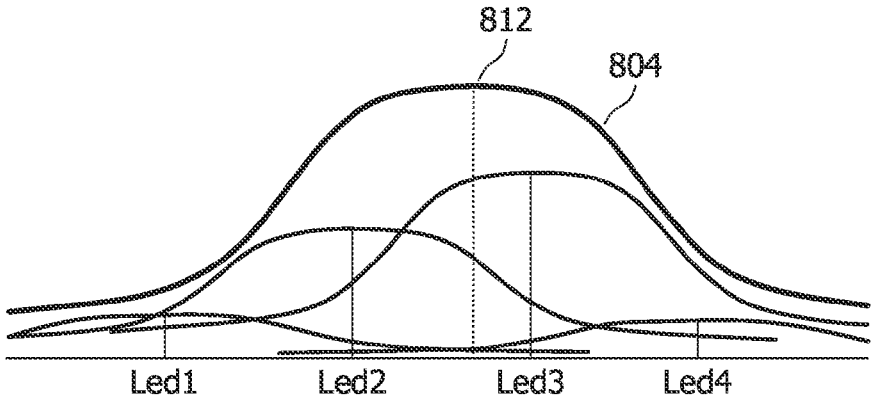
Figure 8C:
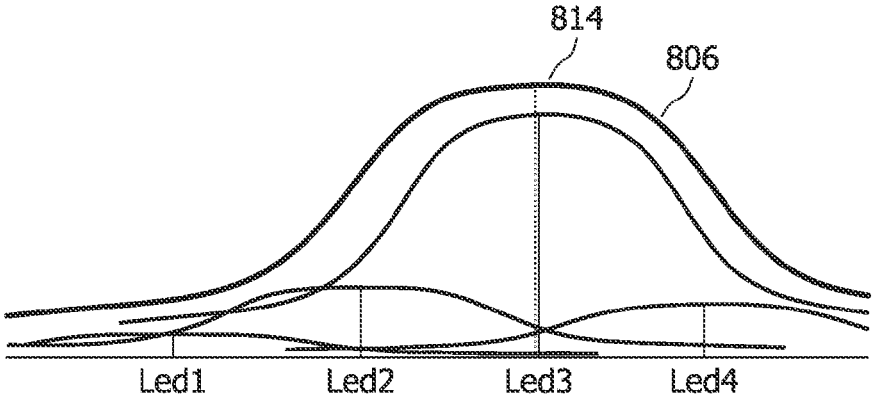

FIG. 8 shows three graphs having position on the horizontal axis and luminance on the vertical axis. It shows in graphs A, B, and C, three different backlight profiles (or 'virtual LEDs') 802, 804, and 806 that have their maximum at different positions with respect to fixed positions of four LEDs (Led1, Led2, Led3, and Led4). The backlight profiles 802, 804,806 have the same shape, but at shifted positions. The shape of the backlight profile and the rate of descend is independent of the position of the backlight profile with respect to the light source positions Led1,Led2,Led3,Led4. In the graphs A, B, and C, also the light profiles 808 of the individual LEDs have been drawn. The amplitude of the light profiles of the individual LEDs varies for the differently positioned maximum 810,812,814 of the backlight profile 802, 804,806. Considering the example of Led2 in the backlight profile of graph A, the weight values or coefficients that are used to compute a candidate drive value of Led2 may be computed, for example, by dividing the height of the maximum of the light profile 808 by the maximum 810 of the backlight profile 802.

To create a specific luminance of the virtual LED, the physical LEDs are preferably driven with the required drive value of the virtual LED, multiplied by a predetermined associated coefficient value. The coefficients can be computed off line, as they are derived from physical parameters such as profiles, spacing etc.

The algorithm according to an embodiment works as follows:

For each virtual LED, the required luminance is determined. This required luminance is preferably based on the target luminance at the center of the virtual LED according to the input signal 1. From this the drive values of the associated physical LEDs are computed. As one physical LED contributes to many virtual LEDs, there are also many drive values that are computed for this physical LED. The maximum value of these values is used as actual drive value for the LED.

To reduce the computational overhead, the number of virtual LEDs may be limited. Instead of one virtual LED per pixel, one virtual LED per area may be used. In this case, the intensity of the virtual LED is computed by taking the maximum luminance of the pixels in an area. Using areas also reduced the memory required by the coefficient tables.

Preferably, a small headroom value is added to the (physical or virtual) LED intensities, so that it is possible to drive the LEDs temporarily beyond the maximum drive value. This helps to take care of any unflatness of the profile of the LED within the area.

The areas are created by dividing the grid formed by the physical LEDS in a finer grid. Each area is then associated with a horizontal and vertical phase with respect to the physical LED grid. For instance, if the horizontal line between two physical LEDs is divided into four steps, we have four phases. If the same is done in the vertical direction, 16 areas have been defined, each having a specific x and y phase, and associated predetermined coefficient tables.

Using the areas, the virtual LEDs still show a (fine) geometric structure, although smaller than the original physical LED pitch. Light is therefore still not generated at exactly the pixel position. In case of motion of bright objects, the virtual LED drive values may jump a bit when the object crosses the boundary between the areas. Preferably, a tradeoff is made between visibility of the grid and the number of phases that are to be implemented.

Maximum light output is achieved when all contributing LEDs are on at 100% drive level. When there is only one small area of maximum brightness, it will be at the peak of a virtual profile, and the contributing physical LEDs are therefore not all on at 100%, and therefore light output will be lower than the maximum achievable. Thus the small area of maximum brightness may not be rendered optimally. There are some ways to counteract this effect. First of all, the maximum brightness of the LEDs may be increased (using the built-in headroom). Second, it is possible to refrain from using full 100% obtainable brightness. Third, it is possible to reduce the brightness of small bright areas. Fourth, it is possible to change the drive algorithm for small bright areas, thereby introducing larger halos for those small bright areas. Fifth, it is possible to increase the width of the virtual LED's profile.

Though the physical profiles preferably are smooth, the shape of the virtual profiles can be chosen more freely. Widening the virtual profile decreases power reduction, but reduces the headroom required. So has introducing a flat top for the virtual profile: to create such a profile by summing physical profiles, it is assured that the nearest LEDs are all used almost equally.

Figure 9:
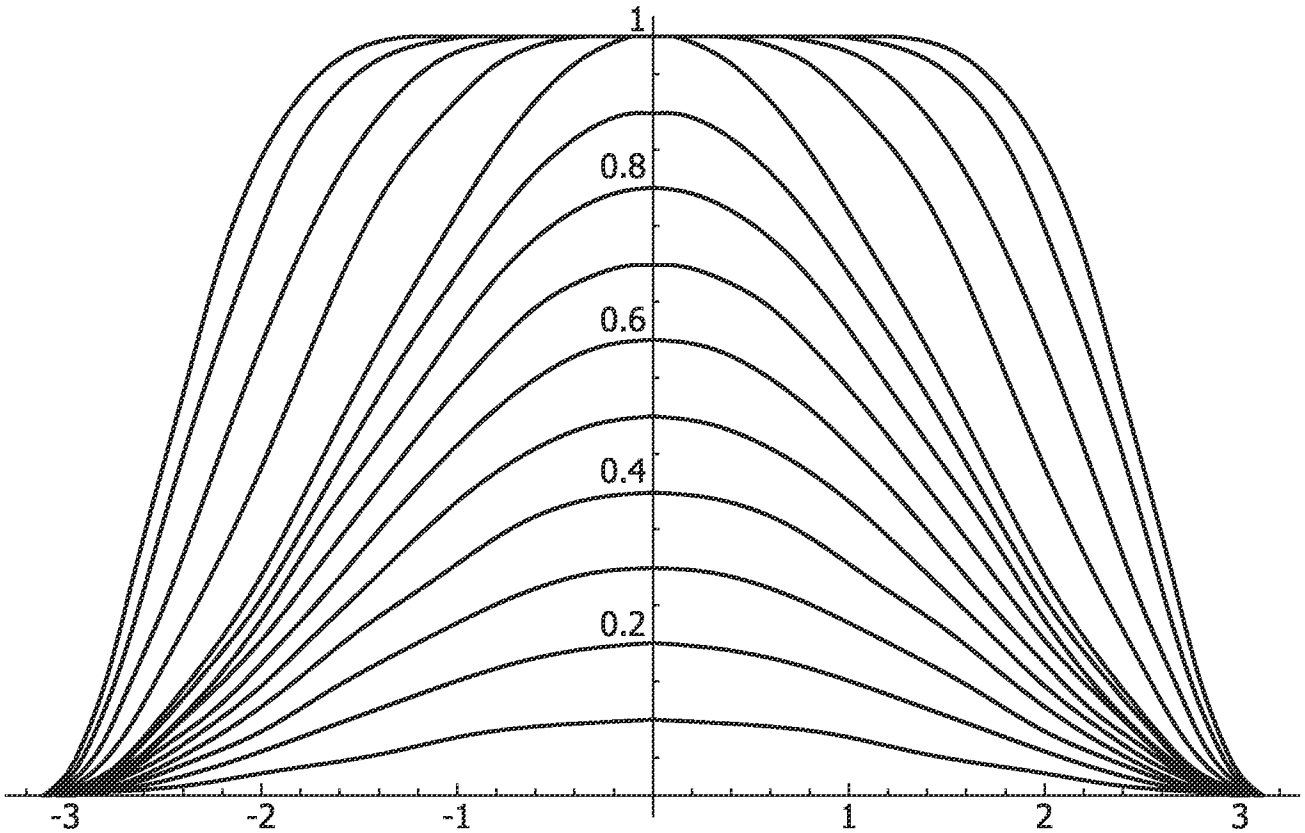
FIG. 9 illustrates several backlight profiles.

FIG. 9 illustrates a way to allow bright spots to be rendered, by adapting the shape of the virtual profile according the brightness level that needs to be reached. On the horizontal axis, this graph has the distance from the center of the virtual profile, and on the vertical axis, the graph has the brightness. Both axes are in arbitrary units. The figure shows that virtual profiles with a high-brightness top have a relatively wide, flat top compared to virtual profiles with a lower-brightness top. Preferably a compromise is chosen between the maximum brightness of small bright objects, and the maximum allowable visibility of halos.

Note that there is no one-to-one relation between physical and virtual profile, as the virtual profile is determined by the physical profile and the coefficients $A_{ij}$. However not all physical and virtual LED profile combinations are equally suitable. The target virtual profile is approximated by a sum of physical profiles. The root mean squared value of the error and the peak values are an indication of how well any given approximation performs.

Figure 10:
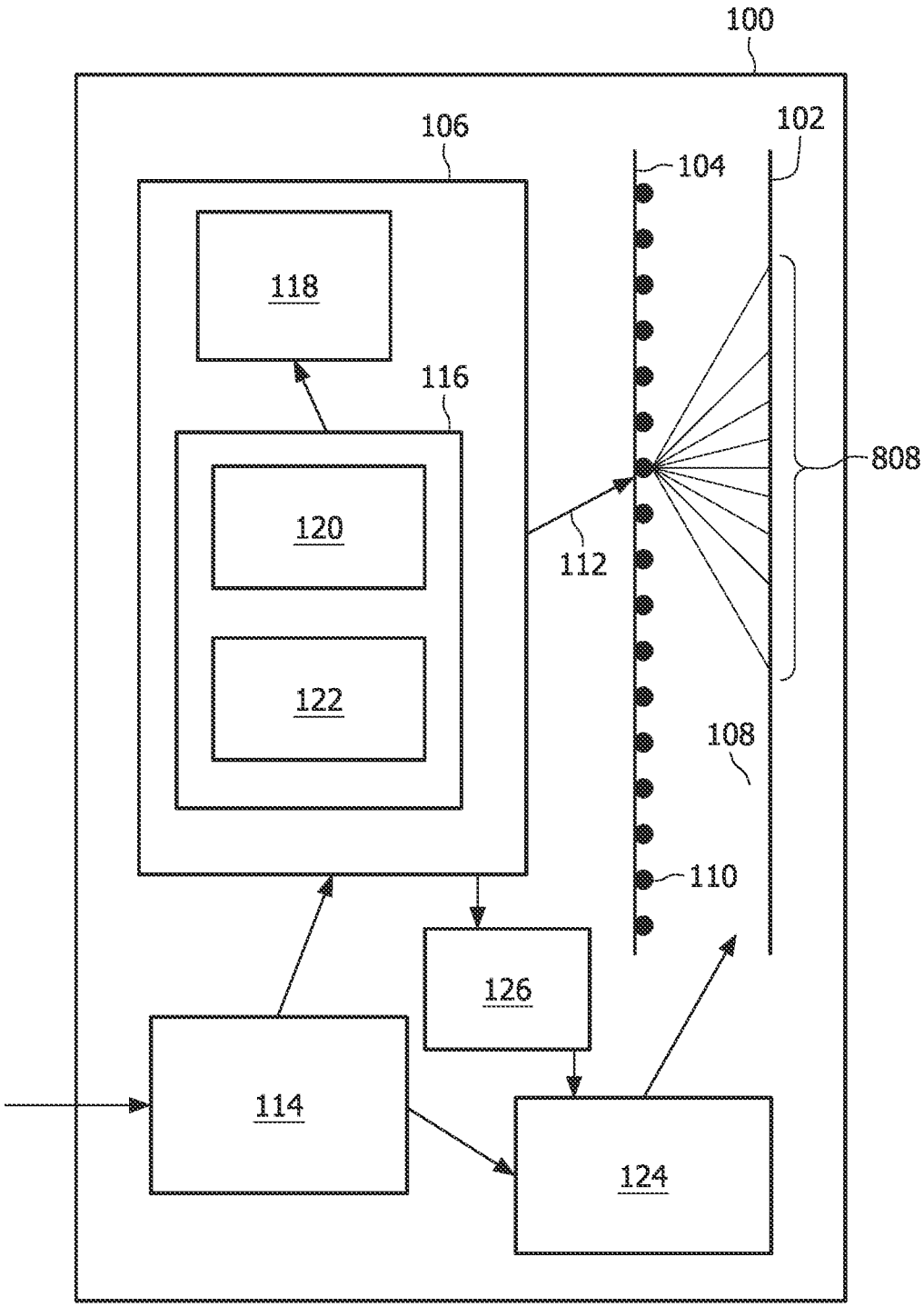
FIG. 10 is a diagram of an embodiment.

FIG. 10 shows a simplified diagram of an embodiment of the invention. The figure shows a display 100 comprising a transmissive display panel 102, for example an LCD display panel, and an adaptively dimmable backlight 104 with a plurality of dimmable light sources 110. A light source in this context means a piece of the backlight of which the luminance can be controlled independently. The light sources 110 of the backlight 104 provide light 808 to the backside 108 of the transmissive display panel 102. The display panel 102 modulates the light provided by the backlight 104 into the desired color that defines the image to be rendered under control of a display panel controller 124. The display 100 comprises an input to receive an image 114 which may be temporarily stored in a memory in the display.

The light sources 110 are positioned at respective predetermined light source positions for providing illumination to respective overlapping portions of the backside 108 of the display panel according to respective predetermined light source luminance profiles 808, wherein an intensity of the light source luminance profile is scalable by means of a light source drive value 112 provided by a drive value generator 106. The light on the backside 108 of the display panel produced by the light sources 110 forms a backlight profile.

The drive value generator 106 provides the light source drive values 112. It determines the light source drive values based on image luminance values corresponding to the image 114 to be displayed by the display. The image 114 may comprise a high luminance image portion having a higher luminance than an area around the high luminance image portion. In such a case, the drive value generator 106 causes the backlight profile to gradually descend around a high luminance portion of the display on which the high luminance image portion is displayed. The rate of descend is independent of a position of the high luminance portion with respect to the light source positions.

The drive value generator 106 may comprise a means 116 for establishing respective candidate drive values for respective light sources based on a luminance in a predetermined portion of the image to be displayed on a predetermined portion of the display. These candidate drive values correspond to light source drive values that would, when applied to the backlight, cause the backlight to generate a predetermined backlight profile that has a maximum luminance at the predetermined portion of the display and that gradually descends around the predetermined portion of the display at a predetermined rate that is independent of a position of the predetermined portion of the display with respect to the light source positions.

The means for establishing the candidate drive values is arranged for establishing different candidate drive values based on the luminance in different predetermined portions of the image to obtain a plurality of candidate drive values for at least one of the light sources. Means 118 is arranged for establishing the light source drive value of the at least one of the light sources in dependence on the candidate drive values. For example, a maximum or minimum drive value is established among those candidate drive values that relate to one of the light sources.

For example, the predetermined backlight profile has a shape representing an enlarged shape of the light source luminance profile. Preferably, the predetermined backlight profile has a limited radius of a limited number of times of a distance between two light sources. For example, the limited number is 5. For example, the limited number is 2.

In an embodiment, the means 116 for establishing the candidate drive values comprises means 120 for establishing a weight value in dependence on a location of the predetermined portion of the display relative to a location of at least one of the light sources.

A means 122 is provided for computing a product of the weight value and a value representing the luminance of the predetermined portion of the image. The output of this means 122 is a candidate drive value. Alternatively, the candidate drive value depends on the output of the means 122. Preferably, the means 122 comprises a plurality of pre-computed values. Means 122 looks up at least one pre-computed value of the plurality of pre-computed values in dependence on the location of the predetermined portion of the display relative to the location of the at least one of the light sources.

A control module may be provided for applying the means for establishing a weight value and the means for computing the product to respective ones of a plurality of predetermined portions of the display. For example, a look-up table is provided in which pre-computed values are stored for each position of a predetermined portion of the display with respect to each position of a light source. The number of entries in the look-up table may be reduced by eliminating equal values using symmetry properties of the light profiles and regularities in the positions of the light sources.

The number of predetermined portions is larger than a number of light sources, because the predetermined portions define the centers of 'virtual' light sources, and a higher number of predetermined portions results in a more detailed control of the final backlight profile.

The predetermined profiles may not only be scaled. There may be a plurality of predetermined backlight profiles having predetermined, different shapes. In an embodiment, the drive value generator comprises means for selecting one of these predetermined backlight profiles in dependence on the luminance in the predetermined portion of the image.

For example, a predetermined backlight profile with a flat top is selected if at least one of the image luminance values exceeds a predetermined threshold value. This allows to increase the maximum of the virtual backlight profile compared to a non-flat predetermined backlight profile.

Optionally, a simulation unit 126 is provided that computes the backlight profile that is generated by the backlight 104 according to the drive values provided by the drive value generator 106. This backlight profile information is forwarded to the display panel controller 124, which adapts the drive values of the display panel to the luminance provided by the backlight 104.

The display panel 102 may comprise an LCD panel, but it may also comprise any other transmissive display, for example based on polymers. The light sources 110 may comprise LED's, but they may also comprise any other kinds of light sources such as fluorescent tubes or conventional light bulbs.

The display 100 may be part of a television, home entertainment system, portable television, computer monitor, or any kind of display device.

In a method of controlling a backlight 104 of a display 100, light source drive values are provided in dependence on image luminance values corresponding to an image to be displayed by the display, thereby causing the backlight profile to gradually decline around a portion of the display at a rate that is independent of the light source positions, the portion of the display comprising a higher luminance than an area around the portion of the display according to the image luminance values.

It will be appreciated that the invention also extends to computer programs, particularly computer programs on or in a carrier, adapted for putting the invention into practice. The program may be in the form of source code, object code, a code intermediate source and object code such as partially compiled form, or in any other form suitable for use in the implementation of the method according to the invention. It will also be appreciated that such a program may have many different architectural designs. For example, a program code implementing the functionality of the method or system according to the invention may be subdivided into one or more subroutines. Many different ways to distribute the functionality among these subroutines will be apparent to the skilled person. The subroutines may be stored together in one executable file to form a self-contained program. Such an executable file may comprise computer executable instructions, for example processor instructions and/or interpreter instructions (e.g. Java interpreter instructions). Alternatively, one or more or all of the subroutines may be stored in at least one external library file and linked with a main program either statically or dynamically, e.g. at run-time. The main program contains at least one call to at least one of the subroutines. Also, the subroutines may comprise function calls to each other. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth. These instructions may be subdivided into subroutines and/or be stored in one or more files that may be linked statically or dynamically.

The carrier of a computer program may be any entity or device capable of carrying the program. For example, the carrier may include a storage medium, such as a ROM, for example a CD ROM or a semiconductor ROM, or a magnetic recording medium, for example a floppy disc or hard disk. Further the carrier may be a transmissible carrier such as an electrical or optical signal, which may be conveyed via electrical or optical cable or by radio or other means. When the program is embodied in such a signal, the carrier may be constituted by such cable or other device or means. Alternatively, the carrier may be an integrated circuit in which the program is embedded, the integrated circuit being adapted for performing, or for use in the performance of, the relevant method.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A backlight control system for controlling a backlight of a display, the display comprising:

a transmissive display panel; and a backlight configured to provide an illumination to a backside of the display panel, the backlight comprising a plurality of respective light sources positioned at respective predetermined light source positions for providing illumination to respective overlapping portions of the backside of the display panel according to respective predetermined light source luminance profiles, wherein an intensity of the light source luminance profile is scalable by means of a light source drive value, and wherein a superposition of the respective scaled light source luminance profiles defines a backlight profile; the backlight control system comprising:

a drive value generator configured to provide the light source drive values in dependence on image luminance values corresponding to an image to be displayed by the display, the image comprising a high luminance image portion having a higher luminance than that of an area around the high luminance image portion, the drive value generator being further configured to cause the backlight profile to gradually descend around a high luminance portion of the display on which the high luminance image portion is displayed at a rate that is independent of a position of the high luminance portion with respect to the light source positions, the high luminance portion of the display having a higher luminance than an area around the high luminance portion of the display, wherein the drive value generator is further configured to emulate virtual light sources at each pixel positions of the high luminance portion of the display so that each pixel of the display at the high luminance portion of the display has a virtual light source.

2. The backlight control system as claimed in claim 1, wherein the drive value generator comprises:

means for establishing respective candidate drive values for respective light sources based on a luminance in a predetermined portion of the image to be displayed on a predetermined portion of the display, wherein the candidate drive values correspond to light source drive values that would, when applied to the backlight, cause the backlight to generate a predetermined backlight profile that has a maximum luminance at the predetermined portion of the display and that gradually descends around the predetermined portion of the display at a predetermined rate that is independent of a position of the predetermined portion of the display with respect to the light source positions, wherein the means for establishing the candidate drive values is arranged for establishing candidate drive values with respect to a plurality of predetermined portions of the image to obtain a plurality of candidate drive values for at least one of the light sources; and means for establishing the light source drive value of the at least one of the light sources in dependence on the candidate drive values.

3. The backlight control system as claimed in claim 2, wherein the means for establishing the light source drive value comprises means for establishing a maximum drive value among the candidate drive values for the at least one of the light sources.

4. The backlight control system as claimed in claim 2, wherein the predetermined backlight profile has a shape representing an enlarged shape of the light source luminance profile.

5. The backlight control system as claimed in claim 2, wherein the predetermined backlight profile has a limited radius of less than five times a distance between two light sources.

6. The backlight control system as claimed in claim 2, wherein the means for establishing the candidate drive values comprises:

means for establishing a weight value in dependence on a location of the predetermined portion of the display relative to a location of at least one of the light sources; and means for computing a product of the weight value and a value representing the luminance of the predetermined portion of the image.

7. The backlight control system as claimed in claim 6, wherein the means for establishing the weight value comprises: a plurality of pre-computed values, and means for looking up at least one pre-computed value of the plurality of precomputed values in dependence on the location of the predetermined portion of the display relative to the location of the at least one of the light sources.

8. The backlight control system as claimed in claim 6, wherein the means for establishing a weight value and the means for computing the product are arranged for being applied to respective ones of a plurality of predetermined portions of the display, a number of predetermined portions being larger than a number of light sources.

9. The backlight control system as claimed in claim 6, wherein the means for establishing a weight value and the means for computing the product are arranged for being applied to respective ones of a plurality of predetermined portions of the display, a number of predetermined portions being larger than a number of light sources.

10. The backlight control system as claimed in claim 9, wherein a predetermined backlight profile with a flat top is selected if at least one of the image luminance values exceeds a predetermined threshold value, to increase the maximum of the predetermined backlight profile.

11. A display comprising:

a transmissive display panel;

a backlight configured to provide an illumination to a backside of the display panel, the backlight comprising a plurality of respective light sources positioned at respective predetermined light source positions for providing illumination to respective overlapping portions of the backside of the display panel according to respective predetermined light source luminance profiles, wherein an intensity of the light source luminance profile is scalable by means of a light source drive value, and wherein a superposition of the respective scaled light source luminance profiles defines a backlight profile; and a backlight control system comprising a drive value generator, wherein the drive value generator is configured to provide the light source drive values in dependence on image luminance values corresponding to an image to be displayed by the display, the image comprising a high luminance image portion having a higher luminance than that of an area around the high luminance image portion, the drive value generator being further configured to cause the backlight profile to gradually descend around a high luminance portion of the display on which the high luminance image portion is displayed at a rate that is independent of a position of the high luminance portion with respect to the light source positions, the high luminance portion of the display having a higher luminance than an area around the high luminance portion of the display, and wherein the drive value generator is further configured to emulate virtual light sources at each pixel positions of the high luminance portion of the display so that each pixel of the display at the high luminance portion of the display has a virtual light source.

12. The display as claimed in claim 11, wherein the transmissive display panel comprises an LCD panel.

13. The display as claimed in claim 11, wherein the plurality of respective light sources comprise LED's.

14. A television comprising the display as claimed in claim 11.

15. A computer monitor comprising the display as claimed in claim 11.

16. A method of controlling a backlight of a display, the display comprising:

a transmissive display panel; and a backlight for providing an illumination to a backside of the display panel, the backlight comprising a plurality of respective light sources positioned at respective predetermined light source positions for providing illumination to respective overlapping portions of the backside of the display panel according to respective predetermined light source luminance profiles, wherein an intensity of the light source luminance profile is scalable by means of a light source drive value, and wherein a superposition of the respective scaled light source luminance profiles defines a backlight profile; the method comprising the acts of:

providing the light source drive values in dependence on image luminance values corresponding to an image to be displayed by the display, the image comprising a high luminance image portion having a higher luminance than an area around the high luminance image;

causing the backlight profile to gradually descend around a high luminance portion of the display on which the high luminance portion is displayed at a rate that is independent of a position of the high luminance portion with respect to the light source positions, the high luminance portion of the display having a higher luminance than that of an area around the portion of the display; and emulating virtual light sources at each pixel positions of the high luminance portion of the display so that each pixel of the display at the high luminance portion of the display has a virtual light source.

17. A non-transitory computer-readable storage medium encoded with a computer program for causing a processor to control a backlight of a display, the display comprising:

a transmissive display panel; and a backlight for providing an illumination to a backside of the display panel, the backlight comprising a plurality of respective light sources positioned at respective predetermined light source positions for providing illumination to respective overlapping portions of the backside of the display panel according to respective predetermined light source luminance profiles, wherein an intensity of the light source luminance profile is scalable by means of a light source drive value, and wherein a superposition of the respective scaled light source luminance profiles defines a backlight profile;

the computer program comprising instructions for:

providing the light source drive values in dependence on image luminance values corresponding to an image to be displayed by the display, the image comprising a high luminance image portion having a higher luminance that that of an area around the high luminance image portion;

causing the backlight profile to gradually descend around a high luminance portion of the display on which the high luminance image portion is displayed at a rate that is independent of a position of the high luminance portion with respect to the light source positions, the high luminance portion of the display having a higher luminance than that of an area around the high luminance portion of the display; and emulating virtual light sources at each pixel positions of the high luminance portion of the display so that each pixel of the display at the high luminance portion of the display has a virtual light source.

* * * * *